US006155894A

United States Patent [19]

Allison

[11] Patent Number: 6,155,894

[45] Date of Patent: Dec. 5, 2000

[54] OFF-CENTER MARINE OUTBOARD SKEG

[76] Inventor: Darris E. Allison, 106 Main St., Louisville, Tenn. 37777

[21] Appl. No.: 08/941,953

[22] Filed: Oct. 1, 1997

[51] Int. Cl.[7] ..... B63H 5/16

[52] U.S. Cl. ..... 440/71; 114/140

[58] Field of Search ..... 440/66, 71, 113, 440/78; 114/140

[56] References Cited

U.S. PATENT DOCUMENTS

| | | | |
|---|---|---|---|
| 885,370 | 4/1908 | Palmer | 114/142 |
| 3,635,186 | 1/1972 | German | 114/57 |
| 4,096,819 | 6/1978 | Evinrude | 440/71 |
| 4,854,904 | 8/1989 | Wahl | 441/79 |
| 5,007,868 | 4/1991 | Fry | 440/113 |
| 5,344,349 | 9/1994 | Meisenburg et al. | 440/80 |

FOREIGN PATENT DOCUMENTS 255126 7/1926 United Kingdom .

*Primary Examiner*—Jesus D. Sotelo
*Attorney, Agent, or Firm*—Luedeka, Neely & Graham, P.C.

[57] ABSTRACT

An outboard or stern marine drive assembly includes a skeg that is detachably secured to the lower gear case. The skeg plane is laterally off-set from the vertical plane that passes through the propeller thrust axis. One embodiment of the thin, high-strength steel skeg is secured by a "T" section along the top edge of the skeg to mesh longitudinally with a corresponding T slot in the gear case wall. In another embodiment, the skeg is flush mounted to a boss surface cast integrally with the shell wall of the gear case.

21 Claims, 6 Drawing Sheets

OFF-CENTER MARINE OUTBOARD SKEG

BACKGROUND OF THE INVENTION

The present invention relates to marine propulsion assemblies. More specifically, the present invention relates to marine drive units having a skeg element that precedes a propeller for steering control, propeller protection and running stability.

Traditionally, outboard and stern marine drives have included a vertical drive shaft surrounded by and aligned within a faired housing that is secured to a vessel transom. The lower end of the drive shaft housing is terminated by a gear case or pinion housing. A propeller mounting arbor is aligned within the gear case and projects from the aft end of the case. The internal end of the arbor carries a pinion gear that meshes with a corresponding drive shaft pinion thereby turning the rotational drive line 90°.

Outside of a gear case end wall seal, the projected end of the arbor shaft receives the marine drive propeller by such structural devices as will transmit torque and rotating power to the propeller with accommodation for some degree of shock absorption.

Below the gear case and, traditionally, as an integrally cast extension therefrom, is a radially projecting skeg element. Classically, a skeg is an extended vessel keel that is constructed and positioned to protect the lower rotational arc of a propeller or screw from engaging the bottom of the floatation water body or any submerged obstacles. In an outboard or stern drive, the skeg performs a similar propeller protection function but also functions as a steering rudder. In higher speed ranges, the skeg becomes increasingly important to lateral stability of the vessel and for propeller counter-torque trim.

When a propeller driven light utility or racing vessel achieves speeds in excess of 75 miles per hour, for example, the vessel hull is supported, in large measure, aerodynamically. The only vessel contact with the water support surface is an extremely small area planing pad at the vessel transom.

For running at speeds in this realm, a vessel is preferably "trimmed" to set the propeller thrust axis in the plane of the vessel planing pad. As a direct consequence, half or less than half of the propeller rotational circle is submerged. The skeg, which is leading the propeller through the water, is therefore essential for lateral stability as well as propeller counter-torque and directional control. Directional control also includes opposition to propeller induced yaw moments. The trailing edge of the skeg is given a small cant from planar alignment with the propeller thrust axis for production of a counter yaw-force.

Structural failure of the skeg at high speed can precipitate disastrous consequences. Consequently, the traditional industry manufacturing practice of integrally casting the skeg and lower gear case shell from weaker grades of casting aluminum that are selected more for a low casting temperature and a smoothly finished surface than for strength and toughness is disturbing to those who operate their equipment in these high speed realms.

From another perspective, at high planing speed the skeg profile area, projected into the propeller thrusting arc, represents a significant proportion of the emersed propeller arc. The degree of such proportion is enlarged by the greater skeg sectional thickness required as a consequence of inherently weak fabrication materials. Hence, the magnitude of power robbing drag imposed by the skeg frontal section area is exponentially amplified due to weak fabrication materials.

Furthermore, this skeg profile projection greatly reduces the propeller drive efficiency over the propeller rotational arc past the skeg projection. In brief, the prior art methods of skeg construction disturbs the water ahead of the propeller arc. At these speeds, the result of this disturbance is a turbulent wake behind the skeg. When the propeller blade engages the turbulently disturbed increment of water behind the skeg, thrust efficiency declines.

In other words, the turbulent slip stream left behind the skeg carries a wake of microeddys and counterflows that were generated and energized by passing around the skeg surface. When the propeller blade engages this wake stream, a certain portion of the fluid in that wake has been thrust into directions of high energy movement contrary to the propeller blade pitch bias. Consequently, the acceleration vectors of the propeller activated fluid mass are directionally dispersed thereby reducing the reaction forces along the propeller thrust axis.

Additionally, this turbulent disturbance of the propeller thrust efficiency occurs at the most inopportune position in the semicircular propeller thrust arc. Vertically beneath the gear case, the propeller rotational arc has just attained maximum efficiency by cutting into undisturbed water with a fully wetted blade. At the water surface, the blade enters the liquid body from a gaseous body (atmosphere) thereby carrying a compressible gas surface coating on the blade into the incompressible fluid mass. As the gas is purged from the blade proximity and surface by water displacement, some slippage occurs to diminish the propeller efficiency over that increment of the already reduced proportion arc. Beyond the surface disturbance arc but before the skeg wake, the propeller blade reaches maximum thrust efficiency. When the propeller blade enters the skeg wake, this maximum thrust is instantly compromised and reduced. After passing the skeg wake, the propeller blade no sooner sheds the skeg induced microturbulence than advance elements of the propeller blade root start to rotationally rise out of the undisturbed water.

With respect to a more subtle function of a high speed, outboard drive unit skeg, the dynamics of a particular submerged propeller arc are that the propeller produces more propulsive thrust on one side of the propeller axis than on the other. This asymmetric thrust necessarily induces a yaw moment. Untrimmed, propeller induced yaw moment must be corrected by a cant in the propulsion axis to the direction of travel. This cant in the propeller thrust axis induces additional drag, power consumption and reduced speed. More efficiently, propeller induced yaw is corrected by a slight steerage curl in the vertical trailing edge of the skeg. The direction of the steerage curl is determined by the propeller rotational direction. The degree of steerage curl for a particular equipment combination is somewhat more ambiguous. Moreover, counter yaw skeg curl adjustment by trial and error is frustrated by the fact that the cast aluminum fabrication materials have low properties of yield and ductility. Excess or repeated bending on the skeg structure results in a fracture. Hence yaw control curl must be cast into a cast aluminum skeg. Finding the optimum degree of yaw control curl for a particular combination of boat, engine and propeller can be a frustrating and expensive quest.

Another source of high speed wake turbulence from an outboard marine drive into the propeller arc surprisingly comes from the engine cooling water inlets. Traditionally, these inlets are one or more small apertures, 2 to 4 holes of about ¼ in. diameter, for example, in the frontal surface of the drive unit gear case that channel pickup water into an engine cooling water supply pump. Forward velocity of the gear case drives water into the apertures and generates a substantial dynamic pressure head into the engine coolant pump suction port. Cooling water discharge from the pump is channeled into a pipe located internally of the drive shaft housing. Water from the pump discharge pipe is delivered to the engine cooling jackets.

Since these water inlets represent surface discontinuities on the gear case, water flowing past an inlet but not entering the inlet is directionally disrupted. This directional disruption consequently initiates a turbulent wake that follows the gear case surface into the propeller arc.

It is, therefore, an object of the present invention to position the skeg under the gear case at a location that maximizes the arc of maximum blade thrust efficiency.

Another object of the invention is to increase the area of undisturbed water available to the propeller.

Still another object of the invention is to reduce the skeg profile area.

A still further object of the invention is to provide a slimmer yet stronger skeg structure.

Another object of the invention is to provide a stronger skeg assembly with the gear case.

An additional object of the invention is to provide an easily detachable and replaceable skeg in the event of loss or damage.

Also an object of this present invention is a skeg construction that reduces the magnitude of skeg wake turbulence and drag.

Another object of the invention is removal of an engine cooling water inlet aperture to a less turbulence inducing position on the drive unit gear case.

Another object of the invention is to provide a convenient and flexible means for experimentation with the skeg trim parameters and to maximize the boat performance and efficiency.

SUMMARY OF THE INVENTION

These and other objects of the invention as will subsequently become apparent from the following detailed description, are accomplished by a gear case for an outboard or stern drive having an extremely thin, approximately ¼ in. stainless steel skeg that is off-set from the central vertical plane through the propeller drive arbor axis. The skeg off-set direction is toward the propeller lifting quadrant portion of the submerged propeller semicircle. By asymmetrically aligning the skeg plane near a tangent to the gear case shell, more material area and volume may be engaged to increase the strength of the connective interface with the gear case without disproportionately increasing the parasitic drag area of the gear case.

Such additional joint area and volume permit a deep, T-section bayonet socket tangentially into the gear case shell wall to longitudinally receive a bayonet blade having an upper end T-head projecting from an integral connection with an extremely thin, high strength steel (preferably stainless steel) skeg. Alternatively, the gear case wall may be reinforced with integrally cast bosses to which a thin blade skeg may be secured with flush head machine screws.

Since stainless steel and other ductile, high strength metals may quickly and repeatedly be removed from an integral case boss, the process of finding and correcting the degree of yaw trim for a particular boat and engine combination is greatly facilitated. Yaw trim is further facilitated by the capacity of ductile metals to be relatively easily cold formed.

As a secondary utility, a laterally offset skeg mounting boss provides a nearly ideal envelope for engine cooling water scoops, which may be connected with a cooling water delivery pipe internally of the drive shaft housing.

DETAILED DESCRIPTION OF THE PREFERRED EMBODIMENTS

Figure 1:
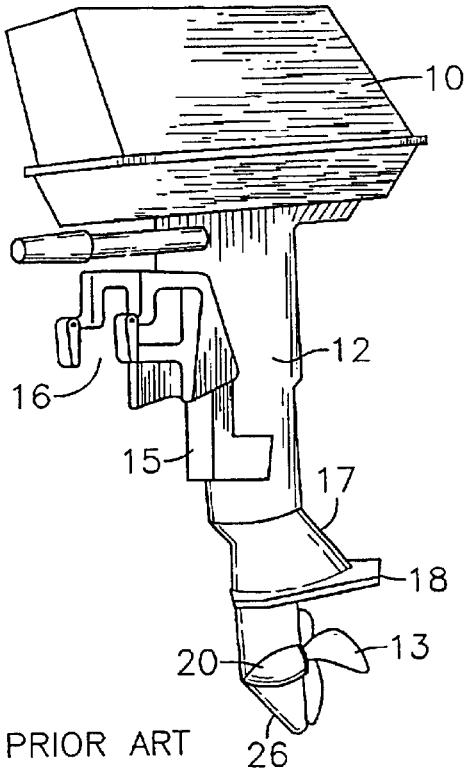
FIG. 1 pictorially illustrates a typical prior art marine outboard propulsion unit.
Figure 2:
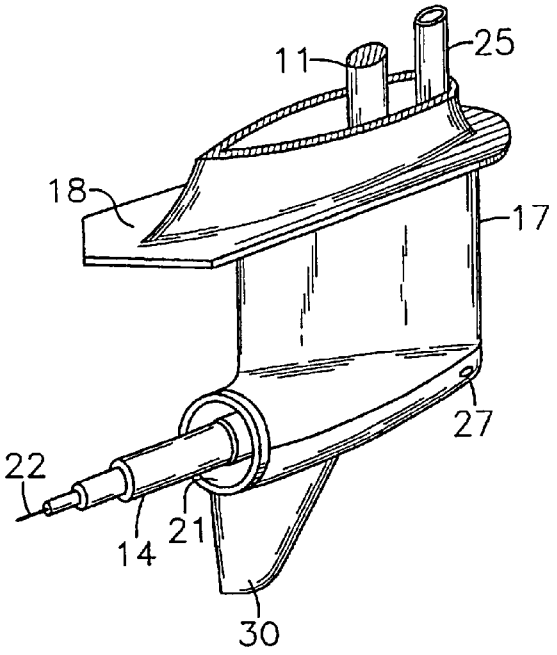
FIG. 2 pictorially illustrates a typical lower drive unit as modified by the present invention.

Relative to the drawings wherein like reference characters designate like or similar elements throughout the several figures of the drawings, FIGS. 1 and 2 illustrate an outboard boat propulsion unit comprising an engine 10 for rotatively driving a vertically disposed drive shaft enclosed within a drive shaft housing 12. The drive shaft is terminated at its lower end with a pinion or bevel gear that meshes with a corresponding pinion at the end of a propeller arbor 14 to turn the rotational axis of the drive line substantially 90° from vertical to horizontal.

A vertical axis steering post 15 is secured to a boat transom mounting bracket 16. The lower end 17 of the drive shaft housing supports an anti-cavitation plate 18 above a torpedo shaped gear case or pinion housing 20. A bearing seal 21 isolates the gear case interior from the surrounding water and a coaxial journal or antifriction bearing maintains the axial alignment of the propeller arbor 14 with the thrust axis 22. The drive propeller 13 is secured to the external end of the arbor shaft 14 by a calibrated shock absorption or shear mechanism such as a friction clutch, an elastomer sleeve or a shear pin.

Figure 3:
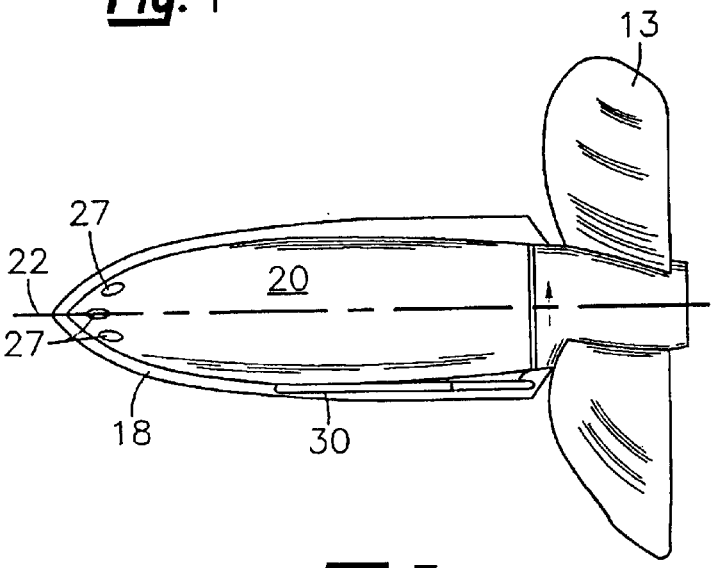
FIG. 3 is a bottom plan view of the invention.

The gear case 20 comprises a bulbus shell confining the interior end of the propeller arbor 14 and the meshing pinion gears. The prior art construction of FIG. 1 illustrates a center plane aligned skeg 26 projecting vertically downwardly from the gear case 20 in substantially co-planar alignment with the propeller drive shaft. Also prior art but illustrated as combined with the invention embodiments of FIGS. 2 and 3 are engine cooling water inlet slots 27. Although three slots 27 are shown, it will be understood to those knowledgeable of the art that more or less such inlet slots or holes may be positioned around the frontal surface area of the gear case 20; usually about the lower half of the case. Those slots 27 are apertures through the gear case shell that are fluid flow connected to the suction port of the engine coolant circulation pump not shown. Discharge from the pump is channeled into the pipe 25 that rises internally of the drive shaft housing 17 and into the engine cooling jackets.

Figure 4:
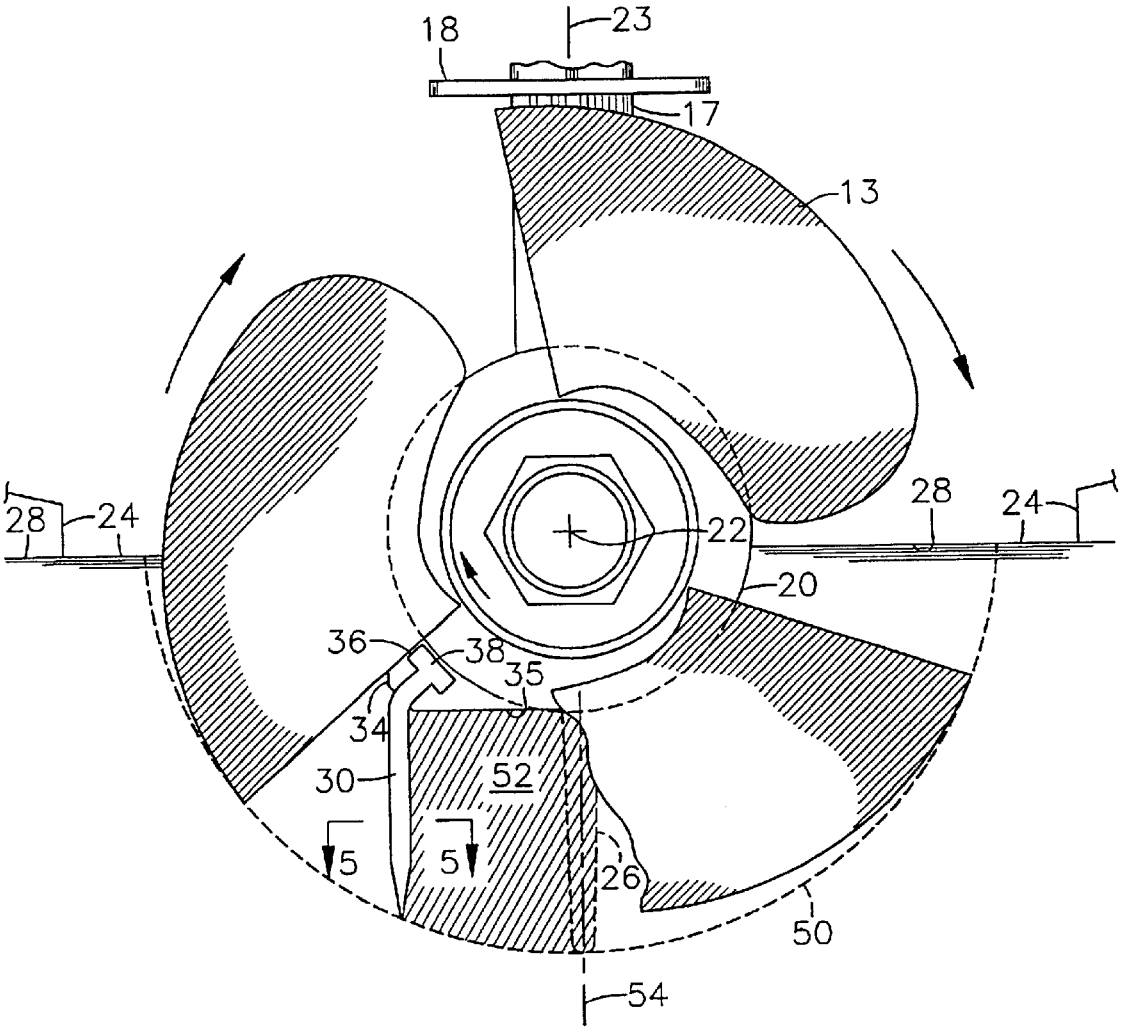
FIG. 4 is an axial end view of the invention.

Constructed according to the present invention as illustrated by FIGS. 2, 3 and 4, the skeg 30 is substantially planar and aligned generally parallel with the thrust axis 22 but laterally off-set therefrom. As best illustrated by FIG. 4, at high speed the boat planing pad 24 is riding the water surface thereby placing the thrust axis 22 of the propeller 13 substantially in or even slightly above the water surface plane 28. Consequently, less than half of the propeller circle is below the water surface. The dashed line semicircle 50 represents the blade sweep of the propeller 13. As viewed frontally from aft of the propeller toward the boat bow, the propeller rotational direction is usually clockwise. However, rotational direction is usually a matter of design convention and convenience. The present description is directed to a clockwise rotation. A cross-hatched area 52 is shown to be bounded between the semicircle 50 and gear case boss 34 and between the prior art skeg position 26 and the present invention skeg 30. This cross-hatched area 52 is laterally off-set to the side of the vertical plane 54 defined by the thrust axis 22. Such lateral displacement is in the direction of the upturning or third quadrant of the propeller circle. Since the down turning second quadrant of the propeller circle is the most efficient of the two, that greater efficiency is continued and enhanced by the invention taught hereby. Hence a significant speed increase may be obtained from a given drive system. Synergistically, the skeg drag may be further reduced by using a sharp, narrow, high tensile strength metal plate skeg. For example, ¼" high nickel alloy or "stainless steel" plate with a highly polished surface provides a skeg of great strength and extremely low fluid resistance. Compared to prior art cast aluminum skeg designs, a thin stainless steel plate skeg may reduce the frontal, cross-sectional area of the skeg by half.

With continuing reference to FIG. 4, an enlarged sector of the gear case shell projects about 45° down into the third quadrant of the clockwise propeller rotation from the propeller thrust axis 22. This enlargement provides a boss 34 for supporting the skeg load. Within the boss 34 is an elongated channel 36, either machined or cast, that functions as a bayonet slide socket to receive the slide inserted T-head 38 of the skeg 30 into position. In its fully inserted position, the skeg is secured by pins or screws not shown. The FIG. 4 embodiment aligns the mounting T-head at about 45° from the plane of the skeg blade 30 to vertically orient the skeg plane.

The T-head 38 insert edge of the skeg 30 may be extended along the full length of the respective skeg mounting root thereby providing a relatively long and continuous load distribution area. If the skeg is formed of a high nickel alloy steel, the T-head sectional shape may be machined, forged or cast. As previously described, the T-head 38 mounting edge of the skeg is preferably inserted into the T slots 36 of the gear case boss 34 by a longitudinal sliding motion. Final longitudinal position may be secured by transverse fasteners such as pins or set screws. This assembly may also employ a shallow angle taper in the T-head 38 and T slot 36 length to provide a predetermined longitudinal abutment position for the skeg along the T slot length and a significant frictional resistance to unintended longitudinal extraction.

As shown by FIG. 4, the lower ramp 35 of the boss 34 provides a flat lifting surface to the gear case 20. Since flat, horizontal surfaces generate immense lifting forces on a light sport boat at speeds exceeding 100 m.p.h., this gear case lifting surface 35 may in some cases become the primary hydrodynamic support surface for the boat. In such an equipment combination, the engine assembly is lifted vertically up along the boat transom to align the plane of the lower ramp surface 35 near the boat planing pad 24. The boat bow weight is supported aerodynamically.

Figure 6:
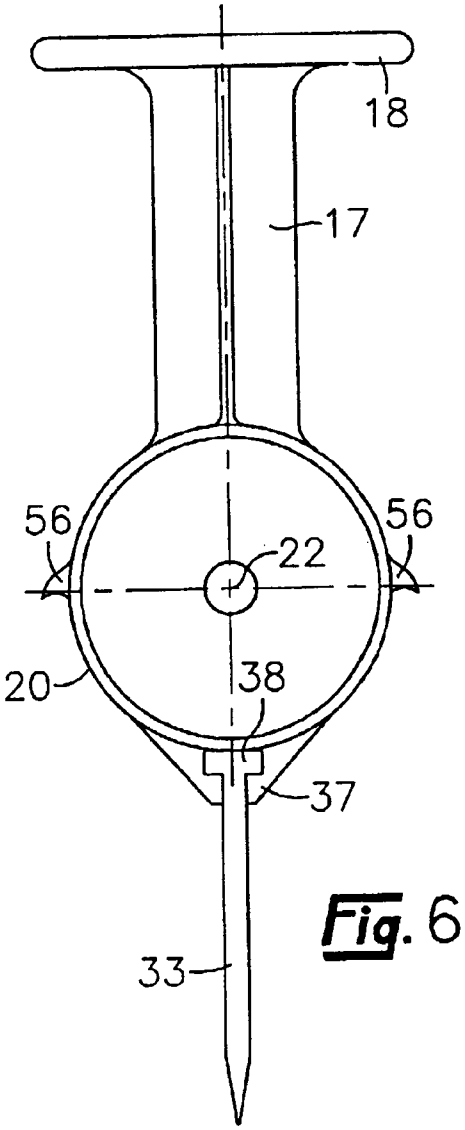
FIG. 6 is an end elevational view of a first skeg assembly joint embodiment of the invention set in the traditional bottom center position.

The invention embodiment of FIG. 6 illustrates a broader utility of the T-head bayonet mount 38 for a narrow plate stainless steel skeg 33 located in the prior art bottom center position relative to the plane of the propeller thrust line. However, in the FIG. 6 embodiment, the skeg support bow 37 acts as a V-bottom boat hull to knife the water with a graduated lifting surface. Wings 56 from the gear case 20 are provided to accelerate acquisition of the boat planing attitude. Upon reaching sufficient speed in the planing attitude, the wings 56 will rise above the water running surface. Concave lower surfaces of the wings 56 are provided to shed running spray from under the wings 56 as quickly as possible thereby reducing the wetted surface area of the gear case above the waterline.

Figure 5:
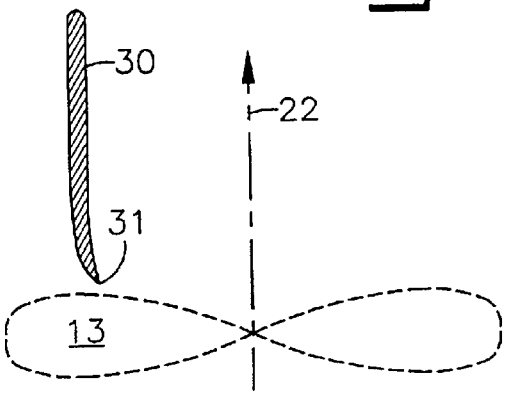
FIG. 5 is a sectioned bottom view of the skeg trailing edge for trial and error correction of the propeller yaw.

FIG. 5 illustrates critical elements of the invention yaw trim feature. From the perspective of viewing plane 5—5 of FIG. 4, the skeg 30 is seen to have a trailing edge 31 that is feathered toward the propeller thrust axis, 22. This feathering provides a counter yaw vector that offsets yaw forces imposed by the propeller. Those with skill in the art will understand that a cold cast aluminum skeg cannot be reliably feathered or shaped after casting. Consequently a cast aluminum skeg must have the counter yaw trim cast into the material structure. This allows little latitude for optimization by experimentation. Although the T-head skeg mount of the present invention provides greater flexibility for experimentation with numerous cast aluminum skegs, each having a different degree of trim feather cast into the skeg plane, a single skeg of a more ductile material such as nickel steel may be progressively feathered until optimized without necessarily removing the skeg from the gear case. Conversely, the skeg 30 may be easily removed from the gear case 20; first, for a more controlled and accurate feather stressing and second, for an accurate measurement of the degree of feather.

Figure 7:
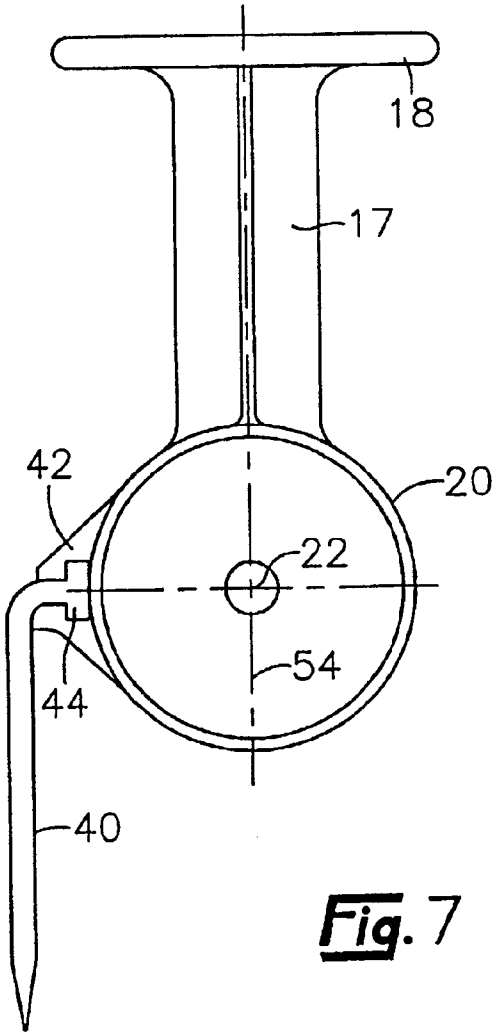
FIG. 7 is an end elevational view of a second skeg assembly joint embodiment of the invention.

The invention embodiment of FIG. 7 sets the T-slot boss 42 in a horizontal alignment plane to receive a skeg 40 mounting T-head 44 turned at 90° to the skeg plane. This FIG. 7 configuration of the invention raises the lower surfaces of the boss 42.

Figure 8:
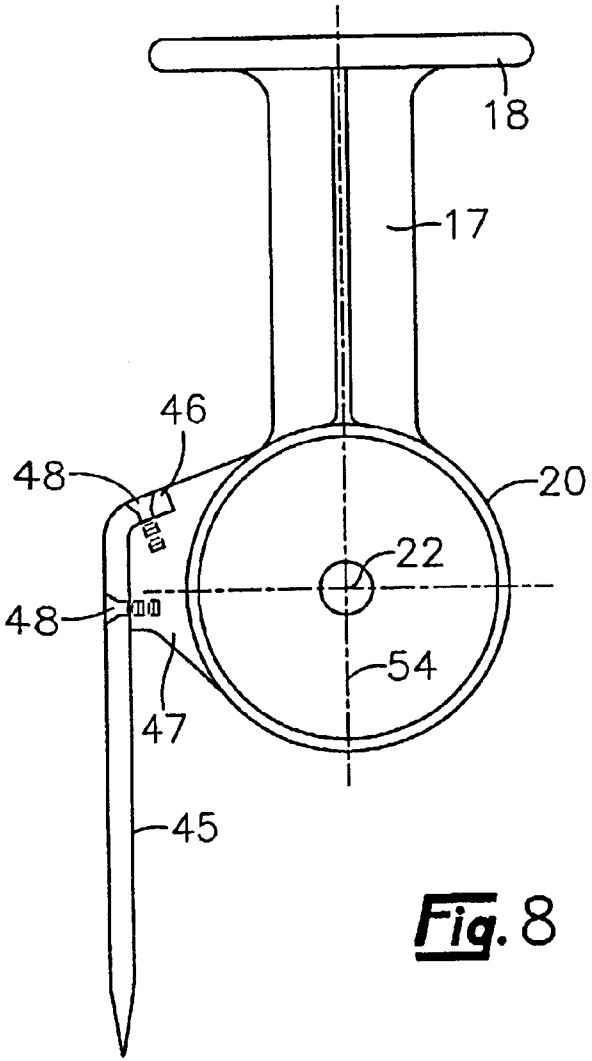
FIG. 8 is an end elevational view of a third skeg assembly joint embodiment of the invention.

FIG. 8 illustrates an embodiment of the invention wherein the thin plate skeg 45 is given a 45° bend 46 along the top edge thereof. A cast boss 47 is predominantly along the upper half of the gear case 20. In this case, the skeg is counter bored to receive flush head screw fasteners such as counter sunk machine screws 48.

Figure 9:
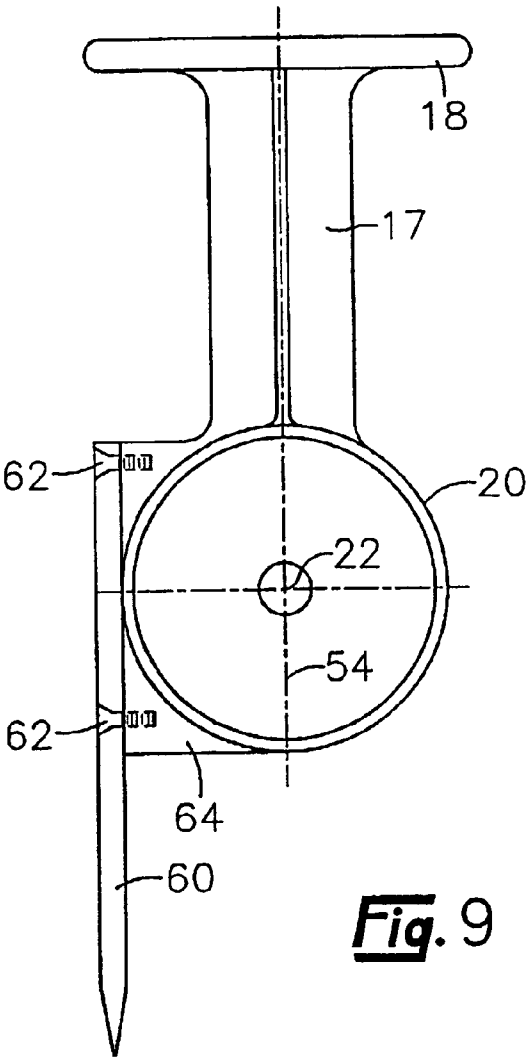
FIG. 9 is an end elevational view of a fourth skeg assembly joint embodiment of the invention.

FIG. 9 illustrates a simplified version of the invention having a thin straight skeg blade 60 flush mounted by countersunk machine screws 62 onto a flat bottom case boss 64. This configuration of the invention has many functional characteristics of the flat bottom T-head mount of FIG. 4.

Figure 11:
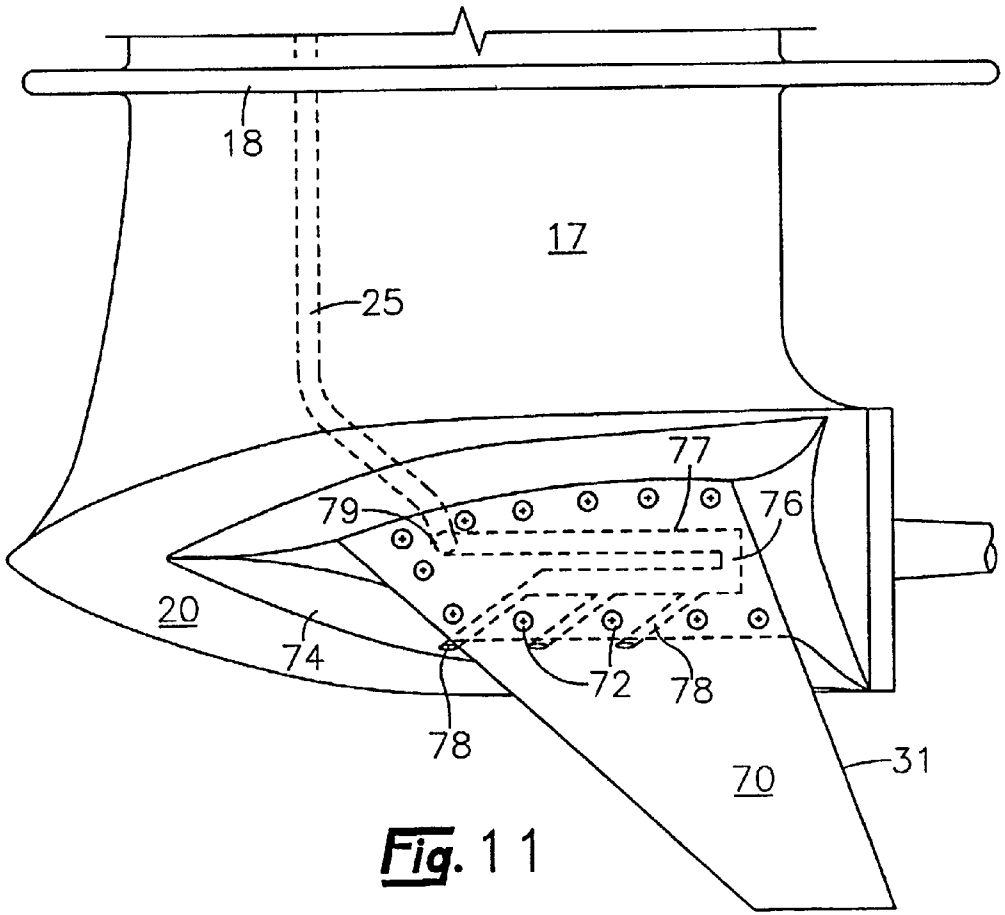
FIG. 11 is a side elevational view of the fifth skeg assembly joint embodiment of the invention.
Figure 10:
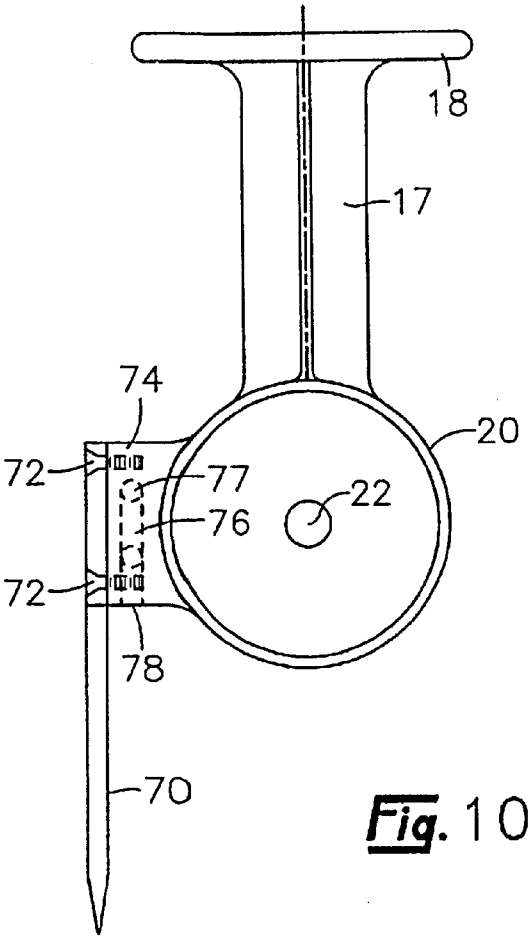
FIG. 10 is an end elevational view of a fifth skeg assembly joint embodiment of the invention.

FIGS. 10 and 11 are respective views of the same embodiment wherein a thin flat plate skeg 70 is attached to the boss 74 by countersunk machine screws 72. Formed within the boss 74, is a U-shaped conduit 76 having a plurality of small diameter water capture apertures 78 along the lower surface.

An upper leg 77 of the conduit has an opening 79 into the engine cooling water pipe 25. Water ramed into the apertures 78 is driven through the conduits 76 and 77 into the water pump for delivery into the engine/cooling water pipe 25.

Figure 13:
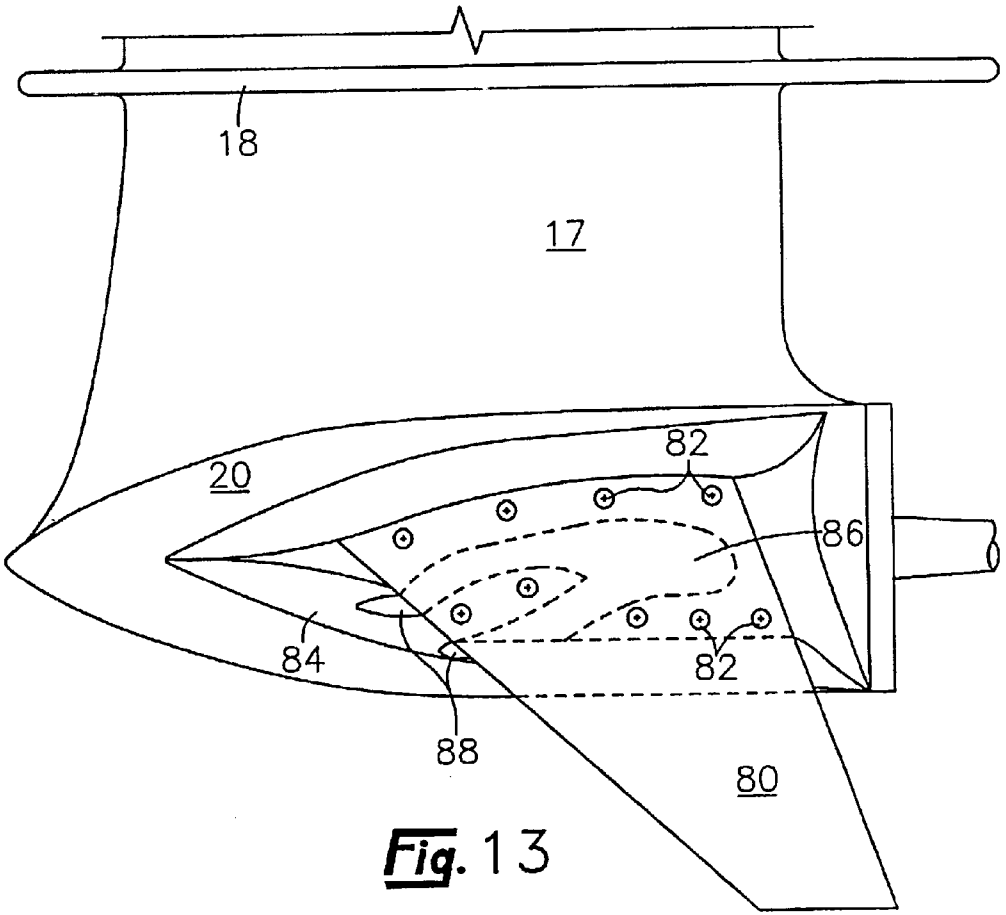
Figure 12:
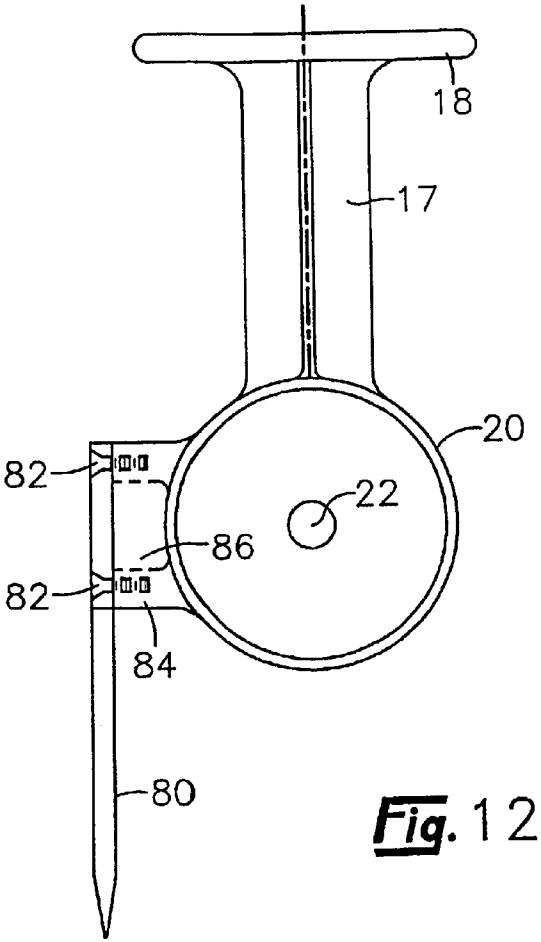
FIG. 12 is an end elevational view of a sixth assembly joint embodiment of the invention; and, FIG. 13 is a side elevational view of the sixth assembly joint embodiment of the invention.

FIGS. 12 and 13 also are respective views of the same embodiment wherein a thin, flat plate skeg 80 is secured by countersunk machine screws 82 to a mounting boss 84. In this case, the boss 84 is cast with an open face channel 86 having frontally open water capture scoops 88. The open face of the channel 86 is enclosed by skeg plate 80, but the scoop channels remain open. These scoops admit engine cooling water into the channel 86 and ultimately into the engine coolant supply pipe 25.

The foregoing description of the preferred embodiments of my invention have been presented for purposes of illustration and description. They are not intended to be exhaustive or to limit the invention to the precise forms described. Obvious modifications or variations are possible in light of the foregoing teachings. The embodiments were chosen and described to provide the best illustration of the principles of the invention and its practical application and to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled. As my invention, therefore:

I claim:

1. A marine propulsion assembly comprising a marine drive propeller having rotational drive elements aligned and secured within an enclosed gear case for rotationally driving said propeller about a thrust axis, said gear case having a substantially planar skeg member projecting therefrom, the plane of said skeg being substantially parallel with said thrust axis and asymmetrically lateral thereof.

2. A marine propulsion assembly as described by claim 1 wherein said gear case and skeg are constructed as separate members that are mechanically secured together subsequent to construction.

3. A marine propulsion assembly as described by claim 2 wherein said gear case includes a socket and said skeg includes a blade for insertion into said gear case socket.

4. A marine propulsion assembly as described by claim 2 wherein said gear case comprises a bayonet socket and said skeg comprises a bayonet blade, said blade being inserted into said socket and secured by transverse pin means.

5. A marine propulsion assembly as described by claim 3 wherein said blade is an extension from said skeg at a substantial angle from the plane of said skeg.

6. An outboard marine propulsion drive gear case for securing, housing and aligning a propeller drive shaft for rotation about a propeller thrust axis, said gear case comprising a perimeter shell substantially surrounding said drive shaft and a steering skeg secured to said shell and projecting therefrom substantially within a plane parallel with said axis and laterally displaced therefrom.

7. A marine propulsion drive gear case as described by claim 6 wherein said shell and skeg are separate, mechanically connected members.

8. A marine propulsion drive gear case as described by claim 7 wherein the fabrication material of said shell is aluminum and the fabrication material of said skeg is stainless steel.

9. A marine propulsion drive gear case as described by claim 7 wherein said shell and skeg are joined by a bayonet joint.

10. A marine propulsion drive gear case as described by claim 9 wherein an end of said skeg adapted to be secured contiguously with said shell comprises a bayonet blade that is inserted into a receptacle portion of said shell and transversely pinned.

11. A marine propulsion assembly comprising an arbor shaft supporting a propeller for rotation about a propeller thrust axis, said arbor shaft being aligned substantially normal to and driven by an engine driven drive shaft and substantially coincident with said thrust axis, at least a portion of said arbor shaft being enclosed within a surrounding gear case, said gear case having a substantially planar skeg projecting therefrom with the plane thereof aligned substantially parallel with said thrust axis and laterally displaced therefrom.

12. A marine propulsion assembly as described by claim 11 wherein said skeg is detachably secured to said gear case.

13. A marine propulsion assembly as described by claim 12 wherein said skeg comprises a mounting blade projecting from a base end of a skeg fin, said mounting blade being inserted into a receptacle slot in said gear case.

14. A marine propulsion assembly as described by claim 11 wherein the plane of said skeg projects from said gear case substantially parallel with said shaft axis.

15. An outboard marine propulsion drive having a gear case for securing, housing and aligning a propeller drive shaft for rotation about a propeller thrust axis, said gear case comprising a perimeter shell substantially surrounding said propeller drive shaft, said perimeter shell having a receptacle slot therein for selectively removable receipt of a skeg mounting edge, and, a detachable skeg having a mounting edge conforming to the shape of said receptacle slot secured to said gear case by meshing said mounting edge within said receptacle slot, said detachable skeg projecting from said perimeter shell substantially within a plane parallel with said axis and laterally displaced therefrom.

16. An outboard marine propulsion drive as described by claim 15 wherein said skeg mounting edge comprises a plunge meshed bayonet blade that is secured within a corresponding gear case socket by transverse fasteners.

17. An outboard marine propulsion drive as described by claim 15 wherein said skeg mounting edge comprises a longitudinally meshed "T" section that is secured within a corresponding gear case slot by transverse fasteners.

18. An outboard marine propulsion assembly having a gear case for securing, housing and aligning a propeller drive shaft for rotation about a propeller thrust axis, said thrust axis disposed within a normally vertical plane, said gear case comprising a perimeter shell substantially surrounding said propeller drive shaft and a substantially planar skeg secured to said shell in substantially parallel alignment with the vertical plane of said thrust axis and laterally off-set therefrom.

19. An outboard marine propulsion assembly as described by claim 18 wherein said shell comprises a skeg mounting boss for securing said skeg to said gear case in a plane that is laterally off-set from the vertical plane of said thrust axis and substantially parallel therewith.

20. An outboard marine propulsion assembly as described by claim 19 wherein said skeg mounting boss further comprises an engine coolant capture opening.

21. An outboard marine propulsion assembly as described by claim 20 wherein said gear case and skeg mounting boss is an integral casting having engine coolant channels formed therein, said coolant channels being enclosed by a stainless steel plate skeg secured to said mounting boss.

* * * * *